United States Patent [19]

Johnson

[11] 4,042,175

[45] Aug. 16, 1977

[54] APPARATUS AND METHOD FOR DISPENSING AND REINFORCING CEMENTITIOUS MATERIALS

[76] Inventor: Iver L. Johnson, 7100 Down Road, Edina, Minn. 55435

[21] Appl. No.: 626,636

[22] Filed: Oct. 29, 1975

[51] Int. Cl.[2] ..... B05B 7/14

[52] U.S. Cl. ..... 239/420; 30/128; 239/433

[58] Field of Search ..... 30/128, 130; 239/147, 239/420, 433, 523, 683

[56] References Cited

U.S. PATENT DOCUMENTS

| | | | |
|---|---|---|---|
| 820,328 | 5/1906 | Alderman | 239/523 X |
| 1,881,345 | 10/1932 | Beatty et al. | 239/420 X |
| 3,033,133 | 5/1962 | Kelley et al. | 239/433 X |
| 3,249,307 | 5/1966 | Peeps et al. | 239/336 |
| 3,801,009 | 4/1974 | Marshall | 239/433 X |

*Primary Examiner*—Evon C. Blunk
*Assistant Examiner*—Michael Mar

[57] ABSTRACT

An improved apparatus for constructing bodies of glass-reinforced cement by a spraying process. The invention includes apparatus for improving the uniformity of distribution of glass fibers in the cement, and apparatus for preventing expensive and inconvenient interruptions in the process due to plugging of the cement gun nozzle.

1 Claim, 12 Drawing Figures

FIG. 5
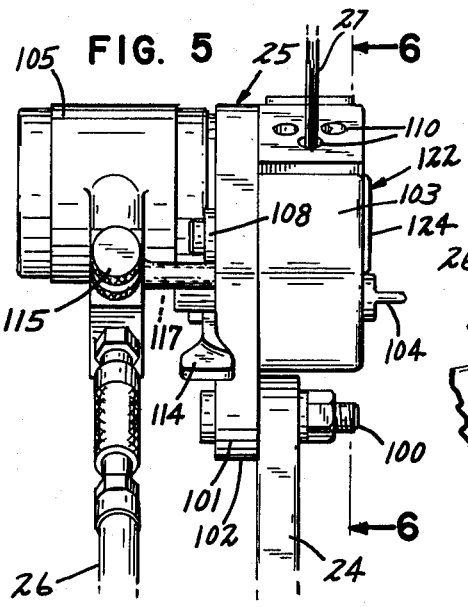
FIG. 6
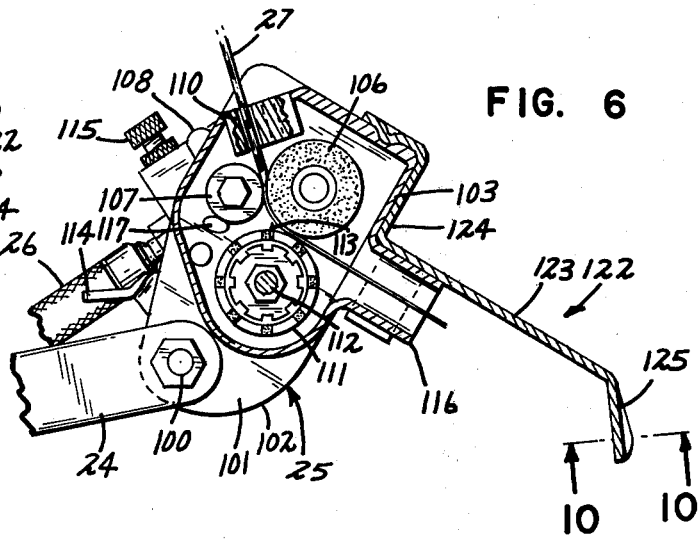
PRIOR ART FIG. 7
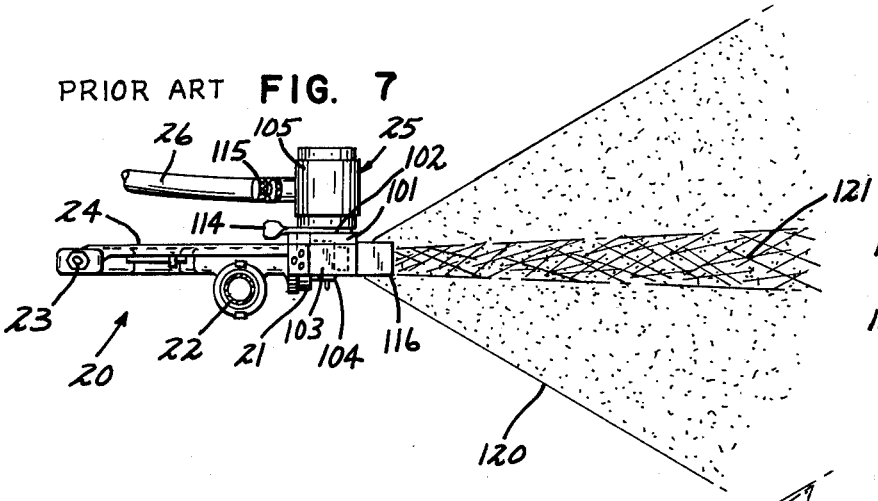
FIG. 10
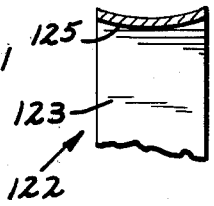
FIG. 11
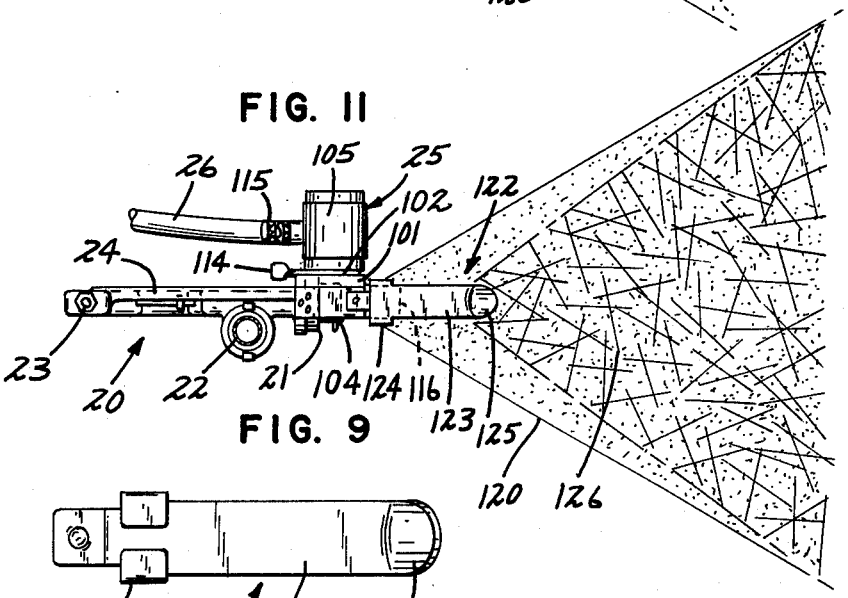
FIG. 9
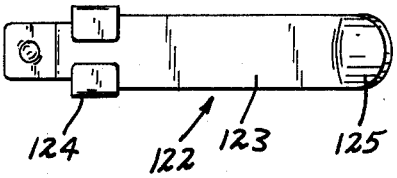

APPARATUS AND METHOD FOR DISPENSING AND REINFORCING CEMENTITIOUS MATERIALS

BACKGROUND OF THE INVENTION

This invention relates to the construction trades, and particularly to the construction of building elements and other objects of cement by the process of spraying the cement against a receiving surface or mold, which determines what will be the surface configuration of the completed element. It is an adaptation and carrying forward of the "spray-up" process used to produce fiberglass-reinforced-plastic articles.

In the spray-up process, one or more plastic materials are fed to a gun which sprays it on a receiving surface or mold configured as the negative of an object to be constructed. The surface is initially treated with a parting compound. Then a plastic material is sprayed until a thin layer of desired thickness covers the mold. Next, short reinforcing fibers of glass for example are projected against the mold with the plastic, to act as a reinforcing medium. After spraying, the object is rolled to complete fiber embedment, cured, and removed from the mold.

Attempts to apply the spray-up technology for use with cementitious materials rather than artificial plastics have presented problems. It is the nature of a freshly mixed mortar that it contains particles or aggregates of particles which are not yet wet, and which in their then form would be too large to pass through the output orifice of the spray gun. It is also unavoidable that a certain number of fragments of hardened cement find their way into the mix, and these also are frequently too large for use. The paste of cementitious material is conducted to the spray gun by means including a progressive cavity pump comprising a special helical rotor turning in a rubber sleeve, and such a pump will pass particles of considerable size. In the gun, however, the paste issues through an aperture of limited size, and any particle in the past which is too large to pass through the aperture simply clogs the aperture, so that the gun must be disassembled and cleaned, greatly delaying and increasing the cost of the construction work.

A second major problem in adapting the "spray-up" process to cementitious materials relates to the distribution of reinforcing fibers. For use with cement, a roving of special glass strands resistant to the chemicals in mortar is available, and there has been developed a fiberglass cutter which dissevers such strands to discrete fibers of glass of chosen length and projects them by air for impingement on the wet cement. Glass fibers in short lengths are useful to reinforce plastic, but structures undertaken with cement require longer fibers for successful reinforcement, and also requires that the fibers be uniformly distributed through the subsurface material.

The above comments make it clear that the spray-up practices found satisfactory in making articles of fiberglass-reinforced-plastic are not entirely successful when objects are to be made of fiberglass-reinforced-cement. A further serious fault in the unmodified process is based on the fact that while plastic readily wets fiberglass and flows readily along and between the fibers, cement does neither readily. A superficial application of glass fibers cannot, for example, be rolled into satisfactory cohesive embedment in the body of cement.

SUMMARY OF THE INVENTION

My invention comprises an improvement in means for constructing reinforced cemetitious bodies by spraying, and not only minimizes the loss of time from plugging of the cement gun by large particles, but also provides automatic delivery of the reinforcing fibers, in acceptable lengths, uniformly over the mold as the material is supplied. My invention operates to ensure that each fiber is fully coated with cement before it is air deposited on the receiving surface, and that the fibers are applied simultaneously with the cement to form an intimate matrix which subsequent rolling need only pack or compress, adhesion of the fibers to the cement having already been accomplished.

Various advantages and features of novelty which characterize my invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

BRIEF DESCRIPTION OF THE DRAWING

In the drawing, FIG. 1 is a general view of apparatus used in the practice of my invention;

FIG. 5 is an elevational view to a larger scale of structure used in my invention to supply discrete glass fibers of desired length, as seen generally from the line 5—5 of FIG. 1;

FIG. 6 is a sectional view taken along the line 6—6 of FIG. 5;

FIG. 7 is a diagramatic showing of the operation of prior apparatus without the benefit of my invention;

FIGS. 8, 9 and 10 are detailed showings to a larger scale of a deflecting element used to practice my invention;

FIG. 11 is a view like FIG. 7 showing the operation of apparatus including my new invention.

DESCRIPTION OF THE PREFERRED EMBODIMENT

Figures 1, 8:
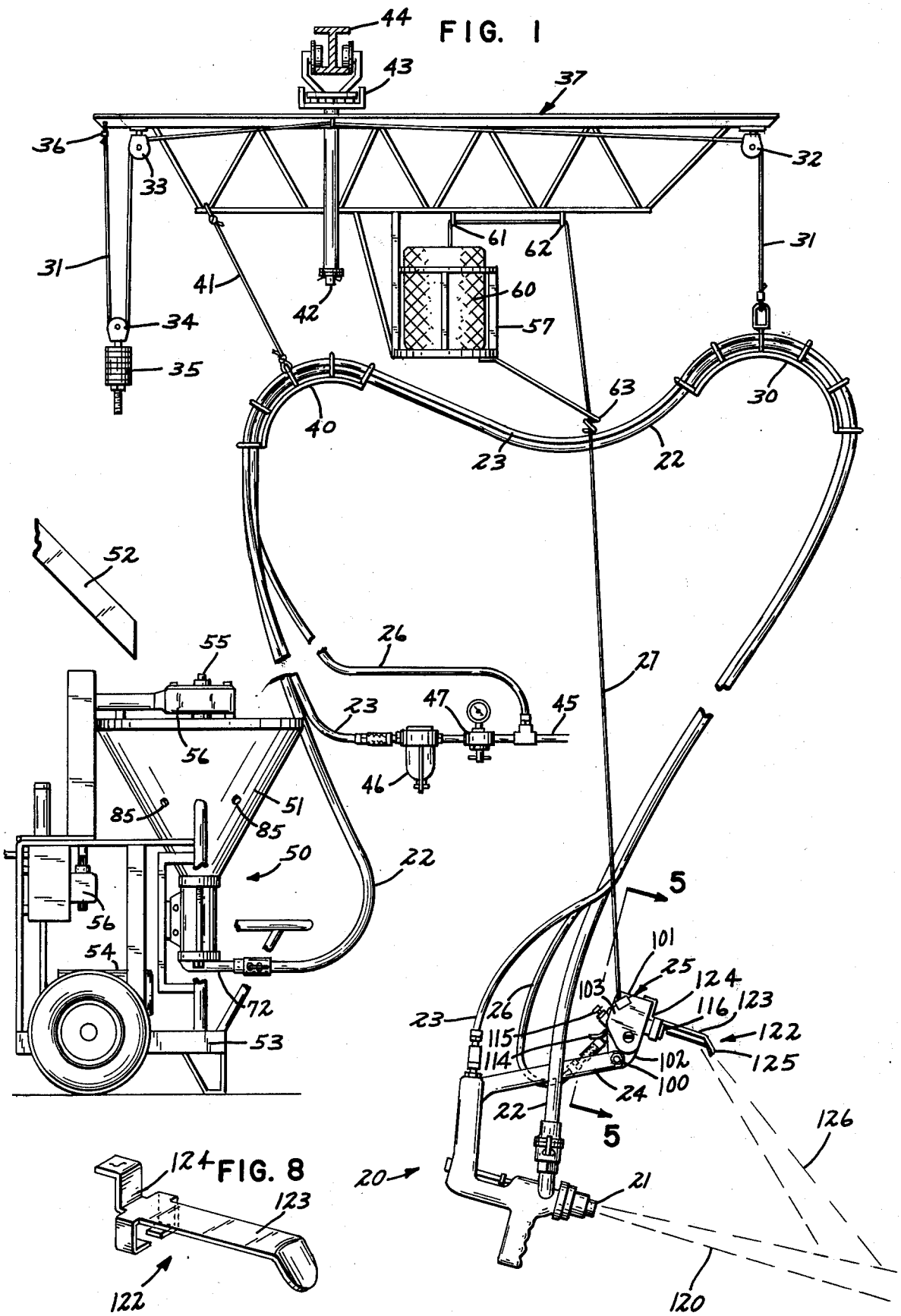

FIG. 1 shows a system for practicing my invention. A "gun" 20 for dispensing cement through a nozzle 21 is shown as supplied with cement paste through a first hose 22, and with compressed air through a second hose 23. In the gun, paste emerging from a metering aperture is entrained by air passing the aperture and projected from the gun in the form of a fan of moist cement particles. Pivotally carried on an arm 24 on gun 20 is a fiberglass chopper 25, supplied with compressed air through a hose 26, and receiving a roving 27 of fiberglass strands. The several hoses pass over a first saddle 30 supported by a cable 31 which passes over pulleys 32 and 33 and through the pulley 34 of a counterweight 35 before being secured at 36 to a boom 37. A second cradle 40 is suspended directly from boom 37 by a cable 41, to further support the hoses. Boom 37 is pivoted about a vertical axle 42 depending from a trolley 43 riding in a ceiling beam 44.

Compressed air for the system is supplied in a conduit 45 to which hose 26 couples directly, hose 23 coupling thereto through a filter 46 and pressure regulator 47. Cement paste is supplied to hose 22 by a progressive cavity pump 50 having a conical input chamber 51 arranged to be batch-fed with cement paste from any suitable source, as through a chute 52. Pump 50 may for convenience be mounted on a wheeled vehicle 53. It includes motor means 54 for actuating a drive shaft 55 through a suitable drive train 56. Means, not shown, are provided by means of which the gun operator can initiate and interrupt the streams of paste and air to the gun through hoses 22 and 23.

A skeletal basket 57 is suspended below boom 37 and carries a coil or ball 60 of glass roving of, for example, twenty individual and continuous strands, which is fed to chopper 25 through fixed loops 61 and 62 and a spring loop 63. While another flexible hose can be provided to protect roving 27 in its passage to chopper 25 if desired, this has not been found to be essential, and is not shown here.

Figure 2:
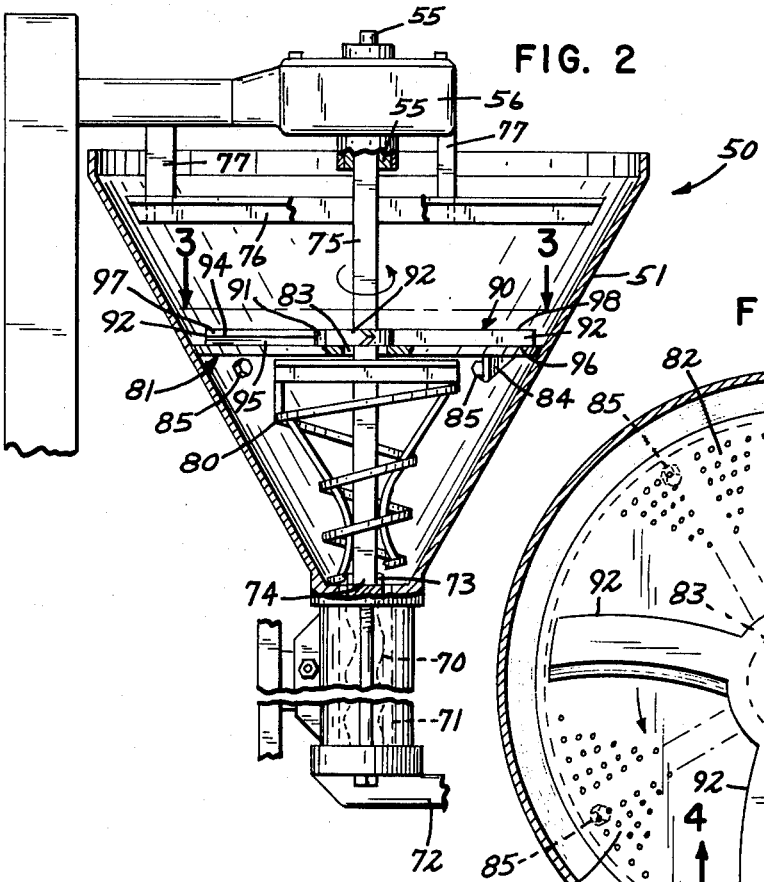
FIG. 2 is a view to a larger scale, partly in section, of a structure used in my invention for supplying cement paste.
Figure 3:
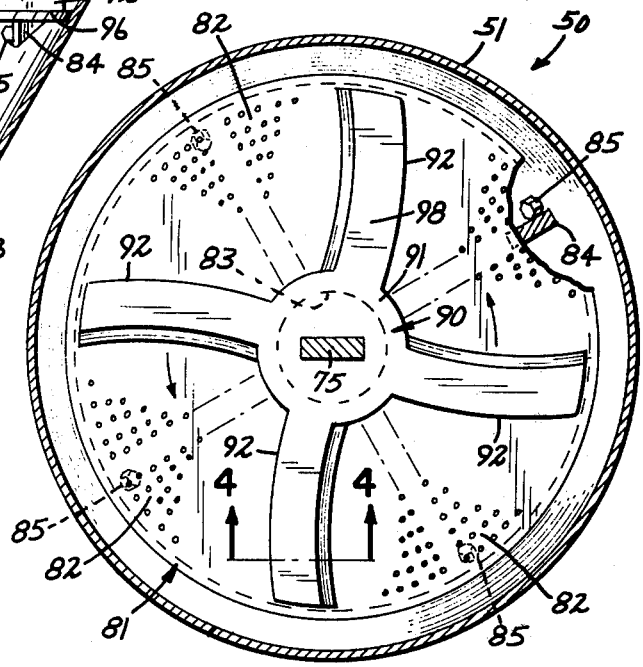
FIG. 3 is a sectional view taken along the line 3—3 of FIG. 1.

FIG. 2 shows pump 50 to comprise a solid, steep-pitch helical spindle 70 of metal mounted for rotation about a vertical axis with respect to a flexible sheath 71 which surrounds it, and having an inside diameter which is substantially that of the envelope of the spiral. The bottom of container 51 opens directly into sheath 71, and the bottom of sheath 71 has a connection 72 for hose 22. The upper end of spindle 70 is formed with a diametal groove 73 or other non-circular aperture for receiving the cooperating end 74 of a removable drive shaft 75. At its upper end, shaft 75 likewise is configured for removably driven engagement, in any suitable fashion, with drive train 56, which may be pivotlly or transationally movable to engage and disengage shaft 75. Suitable structure 76 carried by train 56 as at 77 be provided to support it in driving position over the upper end of container 51.

A tapering coiled actuator 80 is welded or otherwise secured to the lower part of shaft 75. The usual direction of drive of shaft 75 through train 56 is shown by the arrow, and the direction of the pitch of agitator 80 is such as to impel matter in container 51 in a downward direction. If desired, agitator 80 may be constructed to also sweep the inner surface of container 51 and so prevent material from adhering thereto and hardening.

Figure 4:
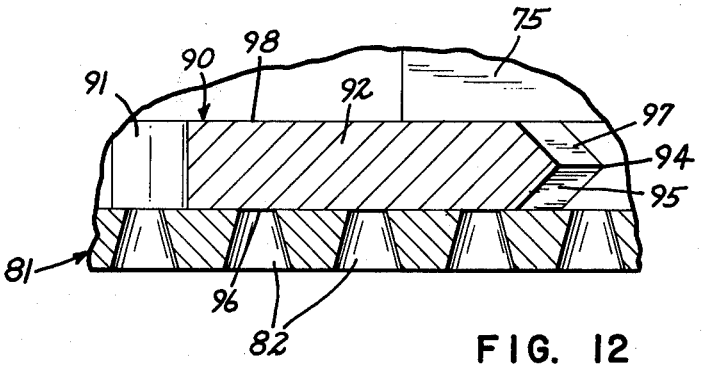
FIG. 4 is a detailed sectional view to a larger scale, taken along the line 4—4 of FIG. 3.

My invention adds to the structure just described a false bottom in the form of a plate 81 which may have a bevelled edge so that the plate engages container 51 directly to prevent passage of material therebetween. Plate 81 has a field of perforations 82 surrounding a central hub with an aperture 83 large enough to permit free passage of shaft 75. Perforations 82 may taper from minimum diameters at the upper surface of plate 81, as is shown in FIG. 4, or may be of smaller diameter at their upper surface and stepped to larger diameter partway through the plate.

As shown in FIG. 2, plate 80 has one or more peripheral lugs 84 depending from its lower surface, and container 51 has a set of projections such as bolt heads 85 positioned to engage lugs 84 and prevent significant rotation of plate 81 in the container.

Cooperating with plate 81 is a flat, bladed member 90 having a central hub 91 provided with an aperture shaped to engage shaft 75, so that when the member is lowered over the shaft it can be driven in rotation therewith, the lower surface 96 of member 91 bearing directly on the upper surface of plate 81. The blades 92 of member 90 are radially concave along their leading edges. Each leading edge is made up of two surfaces extending from a common line of intersection 94 in a direction backward compared to the intended direction of rotation of the member: one surface 95 extends downwardly to the lower surface 96 of blade 92, which engages plate 80. The other surface 97 extends upwardly to the free surface 98 of the blade.

The structure of chopper 25 is shown in more detail in FIGS. 5 and 6. It comprises a housing 101 pivotally connected to gun arm 24 as by a bolt 100 and including a base 102 and a cover 103 secured thereto in any suitable, substantially air-tight fashion, as by a wingnut 104, and an air motor or turbine 105 driven by air supplied through hose 26. Turbine 105 drives a pinch roller 106, which cooperates with an idler roller 107 to draw glass roving 27 through one or more feed apertures 110 into the housing: roller 106 is provided with a suitable resilient surface for this purpose. Means are provided as at 108 for positioning roller 107 with respect to roller 106. A cutting roller 111 is mounted for free rotation on a stud 112, and is arranged to hold up to eight radially projecting blades, one of which is shown at 113. Roller 111 is driven by roller 106, and blade 113 projects only a short distance beyond the surface of roller 111, a distance which is sufficient, however, to enable the blade to compress the surface of roller 106 slightly. Roving 27 passes between roller 106 and roller 111, and the end fibers of the roving are dissevered each time a blade 113 engages roller 106. For convenience, means including a spring biased lever 114 are provided for monentarily displacing the rollers as an aid to intially feeding the roving into the chopper. Admission of air is controlled by a valve 115.

FIG. 6 shows the chopper as it is just before end fibers are cut off from the roving: it will be seen that housing 103 is formed with a nozzle 116 of substantial area, through which the roving is emerging. Air from hose 26 is admitted to the housing through a channel 117, and leaves the housing primarily through nozzle 116. This results in a continuous flow of air issuing from the nozzle in a directed stream containing successive groups of fibers dissevered from roving 27 and exhibiting a considerable degree of mutual alignment. Further details of the structure of a suitable chopper 25 may be found in U.S. Pat. No. 3,491,433.

As shown in FIGS. 1 and 7, the airborne cement issues from gun 20 in a fan-shaped discharge 120 which is narrow vertically and broad horizontally, while the airborne fibers emerge from nozzle 116 in a compact stream shown at 121 in FIG. 7. By appropriately pivoting the chopper on arm 24, the stream from nozzle 116 may be caused to impact the receiving surface, or to impinge laterally on the fan of cement discharging from nozzle 20. The diversity in cross-section between the cement discharge and the fiber discharge makes it very difficult to apply reinforcing fibers uniformly over a receiving surface. To remedy this, my invention adds a deflecter element 122 shown in detail in FIGS. 8–10. Element 122 comprises an arm 123 arranged at one end 124 to be removably secured to housing 103 over nozzle 116, and formed at the other end as a deflecter 125 projecting obliquely into the stream from nozzle 116 and curved convexly toward the flow. The length of arm 123 is preferably slightly greater than the length of the longest cut fibers obtainable from chopper 25.

By the provision of this portion of the invention, the compact flow from nozzle 116 is turbulently convertd to a more diffuse flow 126 impacting on the fan 120 as shown in FIG. 11. The nozzle 116 is directed so that the stream of glass fibers impinges against the stream of cement at a location where it is of substantially the same width, so that wherever cement is projected, glass fibers are also projected, and complete reinforcement uniformity results. The turbulence has the added advantage of converting the fiber orientation from one of substantial alignment to an essentially random one, improving the reinforcing effect of the fibers after they are rolled in.

OPERATION

Figure 12:
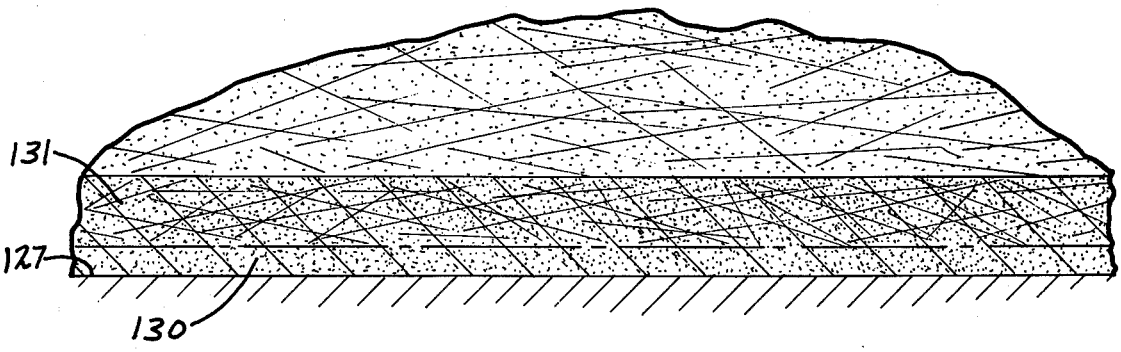
FIG. 12 is a fragmentary view partly in section of a member being constructed using my invention.

The manner of using my invention will now be apparent, referring to FIG. 12. A number of blades are inserted in roller 111 which is sufficient to produce fibers of the desired length. A receiving surface 127 such as a negative mold of an object is suitably positioned, preferably with its major surfaces horizontal, and is treated with a suitable parting material. Air is supplied at 45 and roving is supplied at 60, the roving being fed into chopper 25 by use of lever 114. A batch of cement paste is mixed and discharged through chute 52 into container 51. When the gun operator is ready, he initiates the operation of pump 50, supplying paste to gun 20, and the flow of air to the gun through hose 23. Fan 120 of cement issues from nozzle 21.

In the usual process, the gun operator first deposits on receiving surface 127 a layer of cement 130 free from reinforcing fibers, to establish a desired outer surface for the object. When this has been built up to a sufficient thickness, the gun operator initiates operation of chopper 25: roving 27 is fed into the housing by rollers 106 and 107, and dissevered into fibers of desired length by blades 113, projecting as a compact beam at nozzle 116, and being dispersed into a wide fan by deflecting element 122, to impinge on the fan of cement turbulently before the cement strikes the receiving surface, thus insuring that each fiber is cement coated before it is applied to the mold. A reinforcing layer 131 is thus built up on top of layer 130, and when it is in turn of sufficient thickness, the deposition of material is terminated. At no time is it necessary to interrupt the process because of stopping of the cement gun by large particles. If desired, the exposed surface is rolled to improve the embedment of the last-deposited fibers, after which the cement is allowed to set. Subsequent removal of the form resullts in a sprayed up artical having a smooth outer surface and a strong, uniformly reinforced body.

From the foregoing, it will be clear that I have invented an improved apparatus and method for use in construction of glass reinforced cementitious bodies by a spraying process.

Numerous characteristics and advantages of my invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

What is claimd is:

1. Dispensing apparatus comprising, in combination:

means continuously supplying a paste of cementitious material;

a gun for receiving said material and aerodynamically projecting it as a first flat fan toward a receiving surface;

a housing having a delivery nozzle;

means supplying to said housing a roving of strands of glass compatible with said cementitious material;

means in said housing for continously dissevering said roving to give individual fibers of substantial length adjacent said nozzle;

means supplying air under pressure to said housing for emerging from said nozzle as a compact stream of air bearing said fibers in generally aligned orientation, the transverse dimension of said fan being several times as great as the transverse dimension of said stream in the same direction;

adjustable means securing said housing to said gun so that said fan and said stream have generally the same direction;

diffusing means for impingement by said compact stream to deflect said stream into a second fan which impinges on the first fan near said gun at a large acute angle, the transverse dimensions of said fans at the locus of their impingement being substantially the same, so that said fibers are uniformly distributed with respect to said cementitious material for immediate and complete coating of said fibers by said material;

and means mounting said diffusing means on said housing to extend into said stream at a distance from said housing greater than said length of said fibers, so that said impingement causes turbulence in said stream to result in random orientation of said fibers therein.

* * * * *